US012559284B2

(12) United States Patent
Goldenstein et al.

(10) Patent No.: US 12,559,284 B2
(45) Date of Patent: Feb. 24, 2026

(54) REUSABLE PLASTICS CONTAINER

(71) Applicant: ALPLA Werke Alwin Lehner GmbH & Co. KG, Hard (AT)

(72) Inventors: Daniel Goldenstein, Lochau (AT); Nicolas Thaler, Dornbirn (AT)

(73) Assignee: ALPLA Werke Alwin Lehner GmbH & Co. KG, Hard (AT)

( * ) Notice: Subject to any disclaimer, the term of this patent is extended or adjusted under 35 U.S.C. 154(b) by 55 days.

(21) Appl. No.: 18/701,342

(22) PCT Filed: Oct. 17, 2022

(86) PCT No.: PCT/EP2022/078763

§ 371 (c)(1),
(2) Date: Apr. 15, 2024

(87) PCT Pub. No.: WO2023/066830

PCT Pub. Date: Apr. 27, 2023

(65) Prior Publication Data

US 2024/0417128 A1 Dec. 19, 2024

(30) Foreign Application Priority Data

Oct. 18, 2021 (CH) ..... 70412/2021

(51) Int. Cl.
*B65D 1/42* (2006.01)
*B65D 1/02* (2006.01)

(52) U.S. Cl.
CPC ..... *B65D 1/42* (2013.01); *B65D 1/0207* (2013.01); *B65D 1/0223* (2013.01); *B65D 2501/0036* (2013.01)

(58) Field of Classification Search
CPC ..... B08B 9/0813; B08B 9/093
USPC ..... 215/383
See application file for complete search history.

(56) References Cited

U.S. PATENT DOCUMENTS 1,542,944 A * 6/1925 Kawasaki ..... B65D 13/04 229/5.5
6,827,228 B2 * 12/2004 Headen ..... B65D 1/40 220/675
6,983,858 B2 * 1/2006 Slat ..... B65D 79/0081 215/381
D572,137 S * 7/2008 Dimmel ..... D9/551
(Continued)

FOREIGN PATENT DOCUMENTS

FR 3 104 555 A1 6/2021

OTHER PUBLICATIONS

International Search Report corresponding to PCT/EP2022/078763 mailed Feb. 24, 2023.

(Continued)

*Primary Examiner* — Ernesto A Grano
(74) *Attorney, Agent, or Firm* — Finch & Maloney PLLC

(57) ABSTRACT

The invention relates to a reusable plastics container (100), comprising a container body (20), a container base (10) and a container opening (30) located opposite the container base. A repeating structure (21), in particular a honeycomb structure, formed by depressions (22) and ribs (23) surrounding the depressions (22) is disposed on the container body (20). Alternatively, grooves are disposed on the container body. At least 90% of the surfaces of the depressions (22) and of the ribs (23) and/or the grooves are visible from the container opening (30).

20 Claims, 5 Drawing Sheets

(56) References Cited

U.S. PATENT DOCUMENTS

Figure 1:
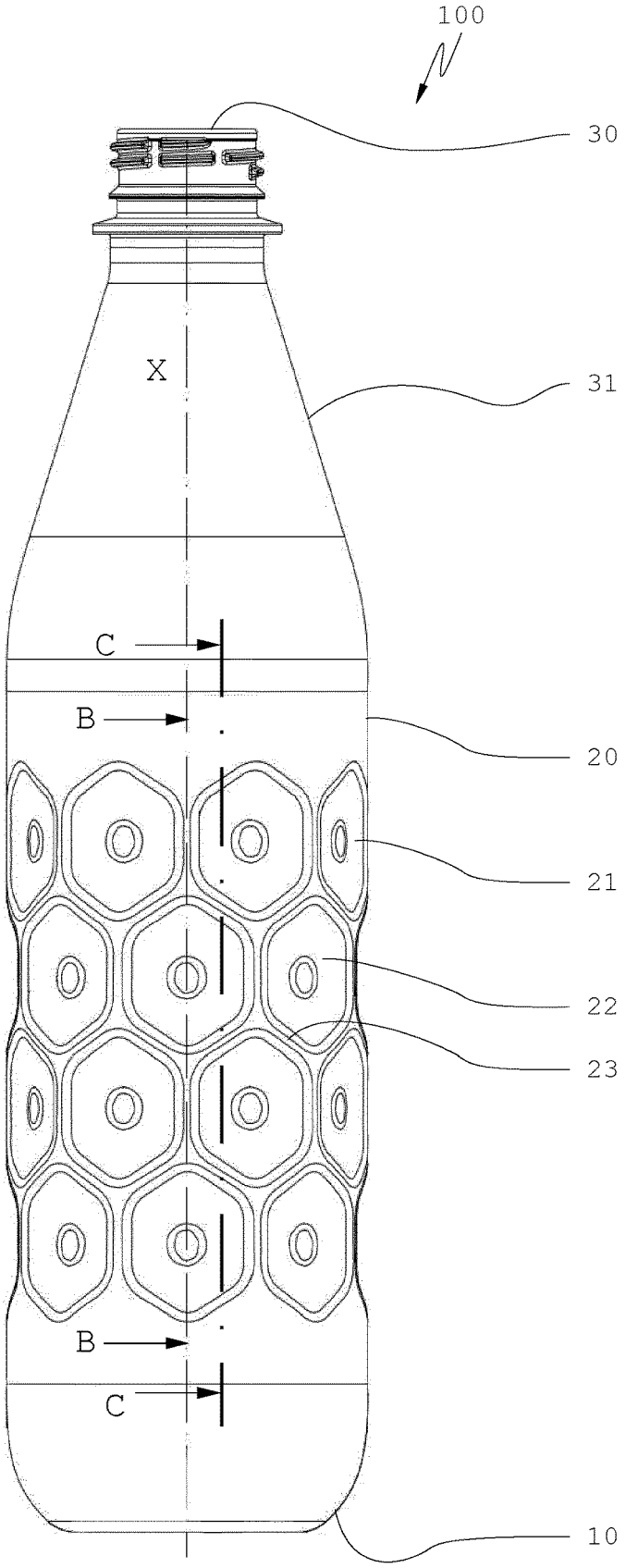

| | | | | |
|---|---|---|---|---|
| 8,381,496 | B2 * | 2/2013 | Trude | B65B 3/022 220/609 |
| 8,444,002 | B2 * | 5/2013 | Schneider | B65D 1/40 220/608 |
| 9,211,993 | B2 * | 12/2015 | Tom | B65D 23/02 |
| 9,248,932 | B2 * | 2/2016 | Gamber | B65D 1/44 |
| 10,167,130 | B2 * | 1/2019 | Pruitt | B65D 81/3876 |
| D981,854 | S * | 3/2023 | Berlepsch | D9/539 |
| D996,220 | S * | 8/2023 | Berlepsch | D9/552 |
| 12,325,554 | B2 * | 6/2025 | Nguyen | B65D 1/0223 |
| 2010/0000962 | A1 | 1/2010 | Lepoitevin et al. | |
| 2010/0032405 | A1 * | 2/2010 | Ozawa | B65D 79/0084 215/383 |
| 2013/0213984 | A1 | 8/2013 | Gamber et al. | |
| 2014/0217054 | A1 | 8/2014 | Kisela | |
| 2017/0304815 | A1 * | 10/2017 | Vachon | C08L 57/06 |
| 2020/0039708 | A1 * | 2/2020 | Twist | B65D 50/046 |
| 2021/0186025 | A1 * | 6/2021 | Ortega | D01F 1/103 |
| 2021/0309798 | A1 | 10/2021 | Goldenstein | |
| 2022/0332473 | A1 * | 10/2022 | Twist | B65D 1/42 |
| 2022/0403157 | A1 * | 12/2022 | Acquasanta | C08G 63/181 |
| 2024/0424723 | A1 * | 12/2024 | Agarwal | B65D 1/0223 |

OTHER PUBLICATIONS

Written Opinion corresponding to PCT/EP2022/078763 mailed Feb. 24, 2023.

* cited by examiner

REUSABLE PLASTICS CONTAINER

The present invention relates to a reusable plastics container according to the preamble of the independent claims.

Reusable containers are containers which are returned to the sales site, for example, and are subsequently reused, i.e. they are refilled.

This process is known in particular for glass bottles. However, these have been replaced with plastics bottles since the production of plastics bottles, unlike glass bottles or also metal bottles, can be carried out with significantly less shaping energy. This results in a significantly better CO2 balance.

Most plastics bottles can be recycled almost completely. The raw materials obtained from old bottles can be reused.

In order to improve the environmental and energy balances, it has already been proposed to design plastics containers as reusable containers and use them several times.

To allow plastics containers to be usable as reusable containers, they must meet other requirements with respect to disposable containers. For example, it must be ensured that they are not permanently deformed during cleaning or during use. This has the result that these containers are designed to be relatively thick-walled. This results in high bottle weights, for example, 500 ml bottles between 35 g and 65 g, and 1000 ml bottles between 50 g and 90 g.

So that the plastics containers can be reused, the collected used plastics containers must first be cleaned before they can be refilled. Since many plastics containers, for example containers made of PET, can soften and deform at relatively low temperatures of, for example, 80° C., a cleaning with boiling water is not an option. Plastics containers are therefore often cleaned at lower temperatures with the aid of alkaline solutions, for example sodium hydroxide solution (NaOH) or potassium hydroxide solution (KOH). The use of 1.2 to 2.4% NaOH alkaline solutions has proven to be practical. The washing process is carried out at a temperature of 50° C. to 70° C. during a period of 60 min.

However, the behavior of polyesters, in particular of PET and PEF, in conjunction with alkaline solutions is not unproblematic. Accordingly, stress cracks in the plastics container can form points of attack for the alkaline solution, at which a degradation of the plastics material can occur over time. In particular, a reaction between ester and lye can lead to saponification.

In hot washing, such containers also become increasingly smaller; the large wall thickness helps keep this shrinkage less than 3% over 15 washing cycles.

As already explained, however, the large wall thickness results in a heavy weight. This has not only a negative influence on the ecological balance, but also on the production costs. Due to the high weight, for example, more energy must also be expended for transporting both the empty and filled bottles.

It is the object of the invention to remedy at least one of the disadvantages of the prior art. In particular, a reusable plastics container is to be created which requires less resources, is preferably cheaper to produce, and in particular has a high stability.

This object is achieved by the reusable plastics containers defined in the independent claims. Further embodiments emerge from the dependent claims.

A reusable plastics container according to the invention comprises a container body, a container base, and a container opening located opposite the container body. A repeating structure formed by depressions and ribs enclosing the depressions is arranged on the container body. This structure is in particular designed as a honeycomb structure. At least 90% of the surfaces of the depressions and of the ribs are visible from the container opening.

This ensures that the corresponding surfaces can be directly exposed to a washing liquid from the container opening.

Depressions are by definition deformations of the container body in the direction of the interior of the plastics container.

It has been found that, during the washing process, in particular when washing PET, laminar boundary layers form relatively quickly and impurities are thereby difficult to remove. This effect is additionally promoted by the fact that both PET and water are polar.

Due to the possibility of directly exposing the surfaces, high flow speeds and turbulence of the washing liquid at the surface can be achieved.

Some microorganisms form gelatinous and/or mucus-like surfaces which adhere to the bottle surface as a coating which is difficult to remove. Direct exposure to washing liquid and the resulting turbulence of the flow promote the removal of these coatings.

However, the presence of structures on the container body promotes the adhesion or even the formation of such coatings.

The present structure, i.e. the elevations and depressions, is therefore preferably designed in such a way that a container can be emptied by being placed upside down, so that less than 0.5% of the filling quantity of the washing liquid remains adhered to the container 3 minutes after the start of the emptying. This ensures that germs can be quickly discharged from the container.

This is achieved or promoted by the accessibility of the surfaces, as described further above.

The residual amount is preferably less than 0.3%, preferably less than 0.1% of the filling quantity.

The depressions and the ribs enclosing the depressions make it possible to lend the container a greater rigidity. The container can thereby be formed with significantly less wall thicknesses so that the material consumption is reduced. The formation of the depressions and of the ribs enclosing the depression so that they are visible from the container opening and accordingly can also be exposed to a jet of washing liquid from the container opening, hereinafter also water jet, ensures that the reusable plastics container can be washed out sufficiently without additional effort so that it can be used again in the food industry.

Preferably, at least 95% of the surfaces of the depressions and the ribs are visible from the container opening.

This increases the surface that can be directly exposed to a water jet.

Particularly preferably, at least 98% of the surfaces of the depressions and the ribs are visible from the container opening.

This further increases the efficiency during washing.

In a particularly preferred embodiment, the surfaces of the depressions and the ribs can be completely seen from the container opening.

A turbulent flow can thereby be generated over the entire surface of the container interior during the entire washing process.

The design of the repeating structure as a honeycomb structure results in a particularly high rigidity and/or insensitivity to influences from external force. A honeycomb structure is a structure consisting of a plurality of hexagonal elements arranged in series.

The honeycomb structure is preferably arranged in such a way that two opposite sides of the hexagon extend substantially along the longitudinal axis of the reusable plastics container, or in the direction of the longitudinal axis. Accordingly, two adjacent sides of the hexagon form ribs which have an inclination toward the longitudinal axis. This promotes the drainage of the washing liquid.

The honeycomb structure has a size between 10 mm and 35 mm. This dimension corresponds in each case to the longest extension of a honeycomb, in other words the distance from two opposite corners.

It has been shown that honeycombs of this size have a high rigidity. The surface enclosed by the honeycomb is sufficiently small to not tend to bulge, but also sufficiently large so that the impression of a textured surface does not arise in which all honeycombs can be deformed together.

The depressions of the honeycomb structure preferably have a depth between 3 mm and 8 mm.

This ensures that the honeycomb structure is designed to be relatively flat, and the surfaces are correspondingly easily accessible from the container opening.

The transitions from the ribs to the depressions preferably have radii which are greater than 1 mm, in particular greater than 1.5 mm. However, these radii preferably do not exceed a size of 3 mm.

As a result, the transitions are not sharp-edged, and liquid adhering in the region of the transitions can drain unhindered.

A further aspect of the invention relates to a reusable plastics container having a container body, a container base, and a container opening located opposite the container body. Grooves are formed in the container body, and are formed at an angle between 0° and 30° relative to the horizontal. At least 90% of the surfaces of the grooves are visible from the container opening.

This design of the container body can be provided additionally or alternatively to the embodiment already described.

These grooves are also depressions within the meaning of this description.

Like the repeating structure described above, these contribute to increasing the rigidity of the plastics container.

Since at least 90% of the surfaces of the grooves are visible from the container opening, the corresponding surfaces can be exposed directly to a washing liquid from the container opening.

The effects that can be achieved with this arrangement correspond to those already described with respect to the repeating structure. Correspondingly, in particular at least 95%, preferably 98%, and particularly preferably the complete surface of the grooves are visible from the container opening.

The rigidity of the container is increased, and the wall thicknesses can be reduced at least regionally.

The grooves can have a width of 1 mm to 9 mm.

This leads to an increased rigidity compared to a container without a groove.

The grooves can have a depth of 1 mm to 6 mm. The maximum depth ensures that impurities located in the groove do not adhere too firmly in the groove and the washing liquid can correspondingly drain easily.

The transitions from the grooves to the container body preferably have radii which are greater than 1 mm, in particular greater than 1.5 mm. However, these radii preferably do not exceed a size of 3 mm.

As a result, the transitions are not sharp-edged, and liquid adhering in the region of the transitions can drain unhindered.

In the region of the container body, the reusable plastics container can have an average wall thickness which is between 0.3 mm and 0.6 mm.

This corresponds to a significant reduction compared to conventional container bodies of reusable plastics containers without stiffening elements, which in turn leads to a lower weight compared to conventional reusable plastics containers.

The reusable plastics container is preferably formed from materials from the list comprising PET, PEN, PLA, PEF, PE, PP, or mixtures thereof.

The aforementioned materials, in particular PET or PEF, have a viscosity of 0.7 dl/g to 1.1 dl/g, preferably up to 0.9 dl/g. The viscosity is measured here according to ASTM D4603 on the input pellets, i.e. before the production of the preform.

Surprisingly, it has been found that, in particular in the case of PET, contrary to the prevailing teaching of using PET with a high viscosity, a lower viscosity is advantageous since in this case the surfaces can be imaged with corresponding precision so that the grooves and the ribs can be precisely imaged.

Copolymers from the list of copolymers with 0.5% to 3% IPA, CHDM, FDCA or DEG are preferably selected as materials.

In particular, PET materials are preferable with a proportion of isophthalic acid (IPA) greater than 1.5 mass percent, in particular with an IPA greater than 2 mass percent, and a proportion of diethylene glycol (DEG) greater than 0.5 mass percent, in particular greater than 1 mass percent. However, the combined proportion of IPA and DEG remains below 5 mass percent, in particular below 4 mass percent.

The addition of IPA and/or DEG enables, in particular, the production of thick-walled preforms in advance since these additives slow the crystallization behavior. In addition, the melting temperature can be reduced by these additives.

The reusable plastics container is preferably designed in such a way that the grooves or the repeating structure of the reusable plastics container stiffens it in such a way that a punctual force of 30 $N/cm^2$ does not cause any permanent plastic deformation. The force is applied to the plastics container over a period of 5 minutes.

This ensures that the reusable plastics container is not deformed during proper use.

The reusable plastics container is preferably designed in such a way that the number of colony-forming units (CFU) after the washing process is less than 30, in particular less than 10.

In order to determine this number, we used a test method from the International Society of Beverage Technologists (ISBT). These corresponding test methods were published in 2004 under the title of "Microbiology Test Methods" Second Edition. Procedure 10, Microbiology Testing of Packaging Containers by Membrane Filtration, was used according to this publication.

Compliance with these requirements ensures that the respective reusable plastics containers can be safely refilled.

The reusable plastics container can be designed in such a way that both a honeycomb structure in sections and additional grooves are formed on the container.

Individual regions with a honeycomb structure and without a honeycomb structure can be separated from one another with the grooves, and the rigidity of the reusable plastics container can additionally be increased.

The reusable plastics container can have a volume of 200 ml to 3000 ml.

The reusable plastics container is preferably produced from a preform in the stretch blow molding method.

The preform has a substantially elongated preform body and is designed to be closed at its one longitudinal end. A gate mark originating from the injection-molding process is usually also found there. Adjoining the other end of the preform body is a neck section which is provided with a dispensing opening. The neck section already has the later shape of the container neck. In many known preforms, the preform body and the neck section are separated from one another by a so-called support ring. The support ring projects radially from the neck wall and serves to transport the preform or the plastics container produced therefrom and to support the preform on the blow mold tool or the plastics container when closing it with a closure cap.

The preform is demolded after its production and can be further processed immediately in a single-stage stretch blow molding method. In a two-stage stretch blow molding method, the preform is cooled and temporarily stored on a stretch blow molding device for further processing separated by space and/or time. Before further processing in the stretch blow molding device, the preform is then conditioned if necessary, i.e. a temperature profile is imprinted on the preform. Then it is introduced into a blow mold of a stretch blow molding device. In the blow mold, the preform is finally inflated according to the mold cavity by a gas, usually air, blown in at overpressure and is also stretched axially with a stretching mandrel.

A spray blow molding method is also already known in which the stretch blow molding process takes place directly after the injection molding of the preform. The preform remains on the injection core which at the same time forms a type of stretching mandrel. The preform is in turn inflated by overpressure according to the mold cavity of a blow mold which is delivered onto the injection core or vice versa, and thereby stretched by the stretching mandrel.

The finished plastics container is then demolded. Stretch blow-molded or injection blow-molded plastics containers can be recognized by the gate mark usually found in the region of the container base and which originates in the preform. At this gate mark, the plastics material is only slightly or not at all stretched.

Figure 2:
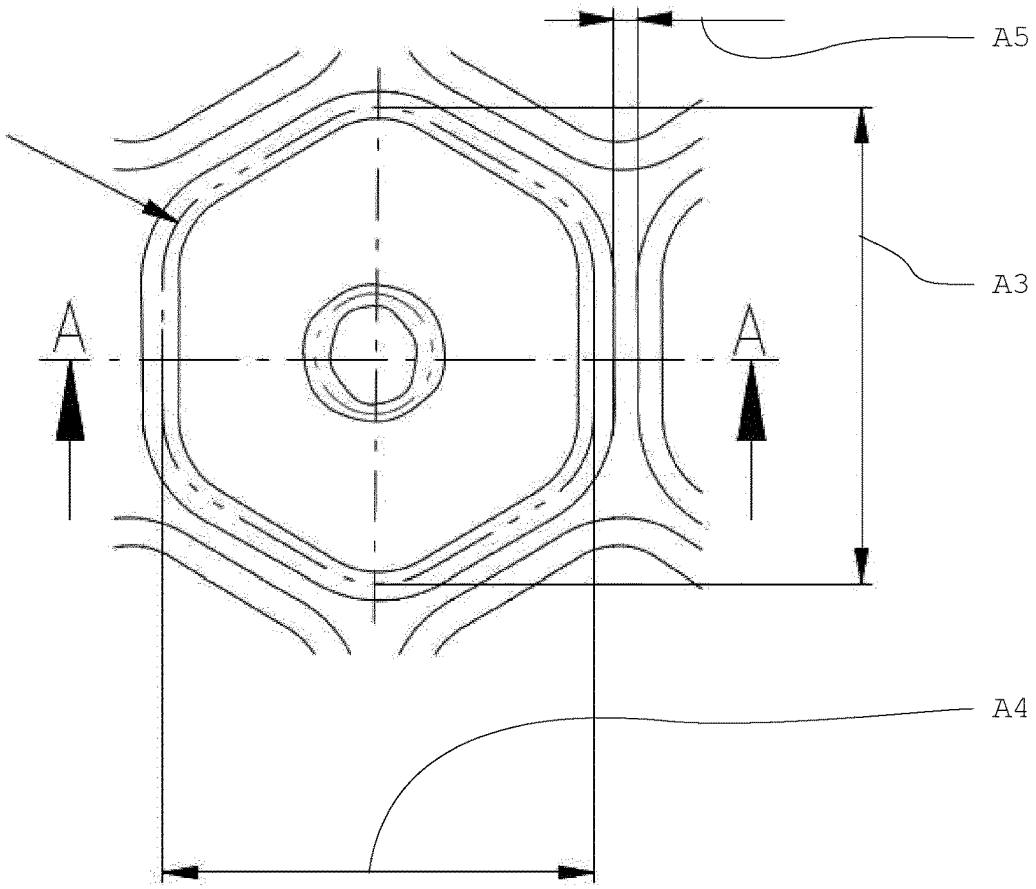
Figure 3:
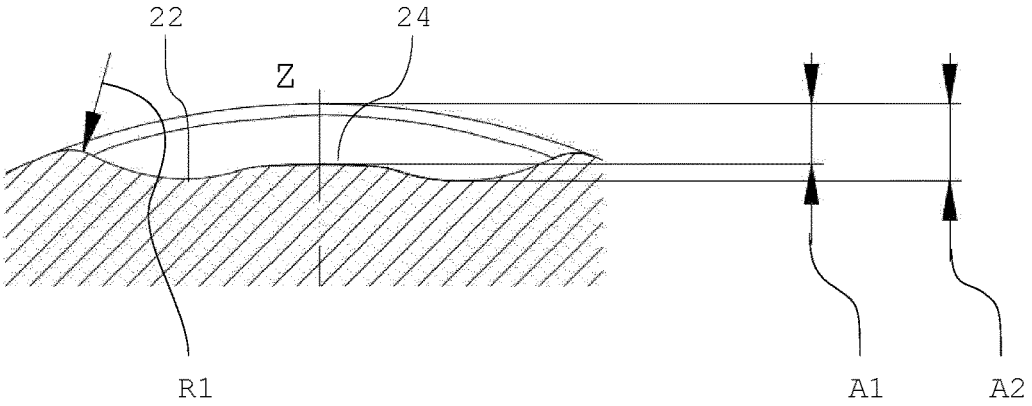
Figure 4:
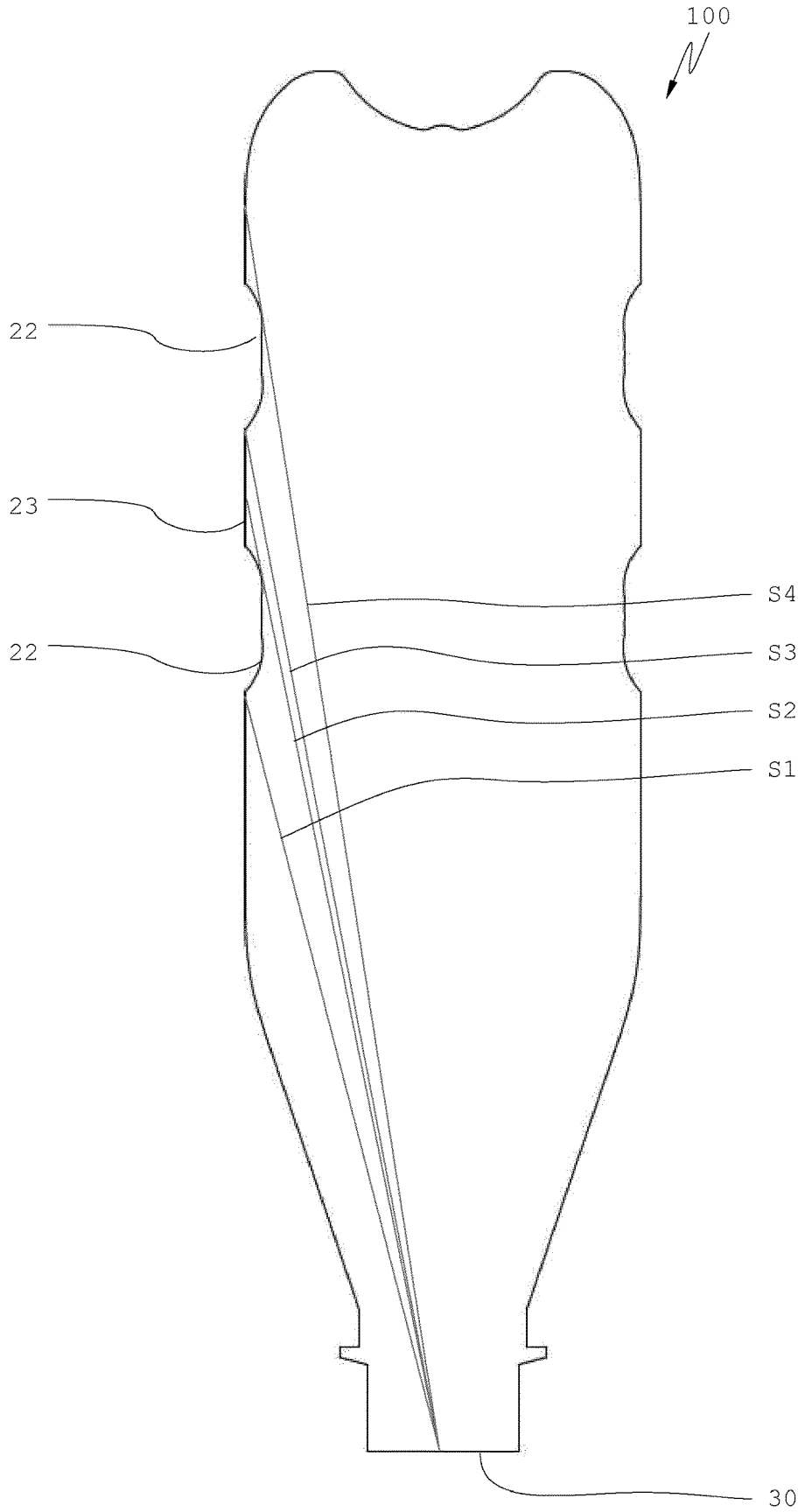
Figure 5:
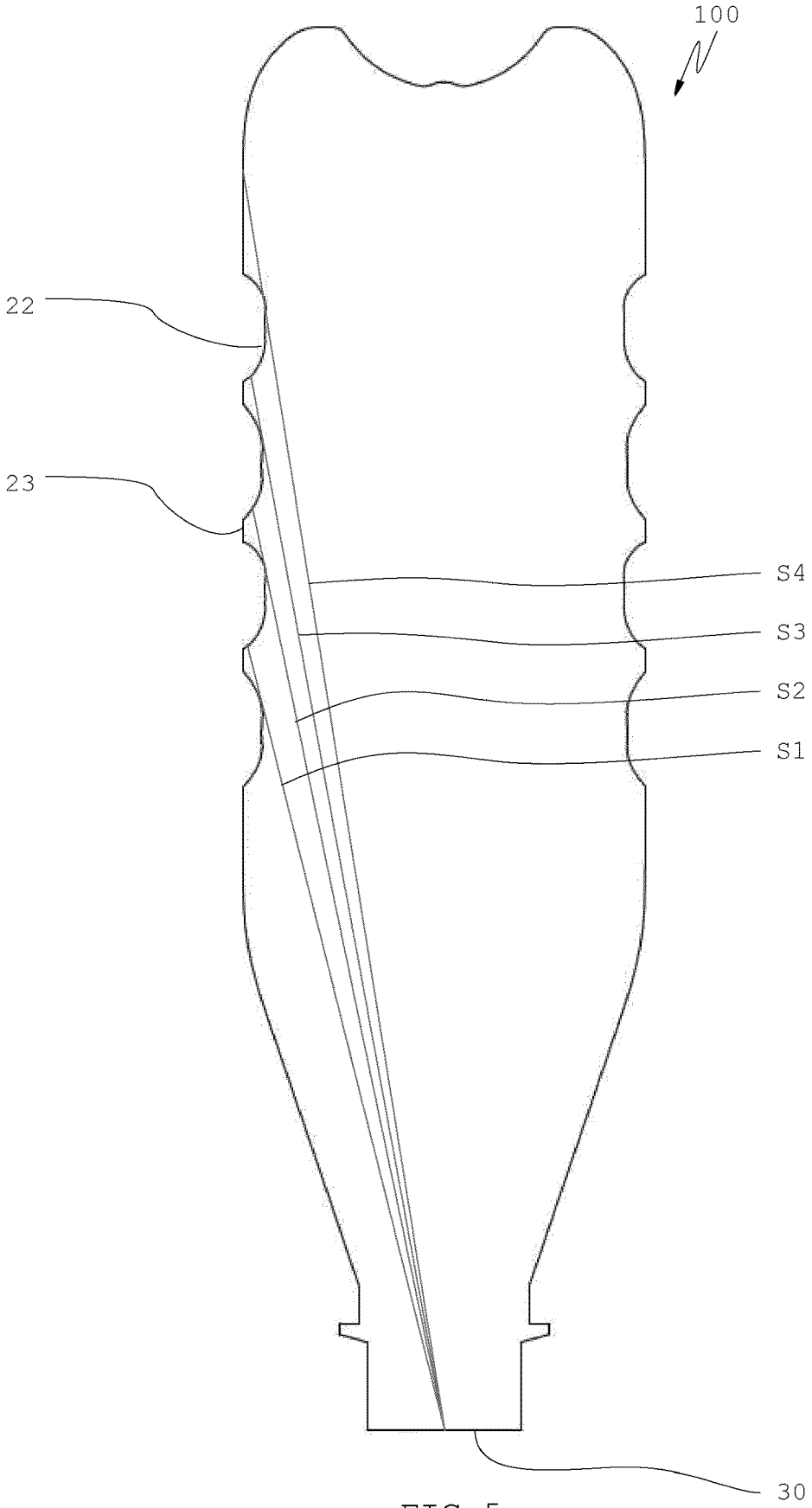
Figure 6:
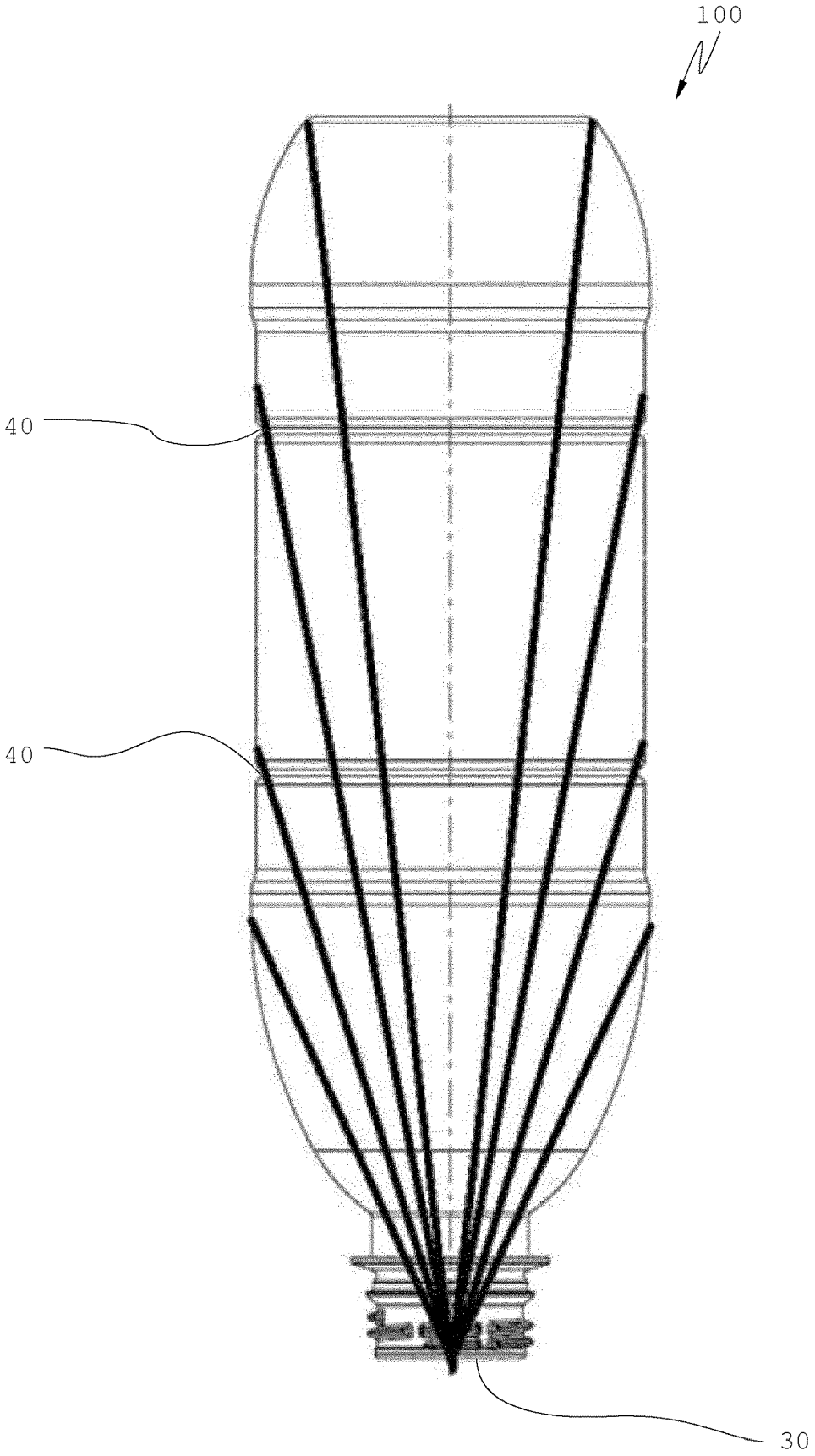

Embodiments of the invention are explained in more detail below with reference to schematic figures. In the figures:

FIG. 1: shows a reusable plastics container;

FIG. 2: shows a detail view of the structure;

FIG. 3: shows a cross-section through the structure;

FIG. 4: shows a sectional view through the reusable plastics container according to FIG. 1;

FIG. 5: shows another sectional view through the reusable plastics container according to FIG. 1;

FIG. 6: shows a sectional view analogous to the sectional view of FIG. 2 through an alternative reusable plastics container.

FIG. 1 shows a reusable plastics container 100. The reusable plastics container 100 has a container body 20, a container base 10 and a container opening 30. The container opening 30 is arranged opposite the container base 10.

The container body 20 is substantially cylindrical between the container base 10 and a conically extending container shoulder 31. A plurality of elements which form a repeating structure 21 are arranged in this region. In the present case, this is designed as a honeycomb structure. The repeating structure 21 consists of depressions 22 and ribs 23 which surround the depressions 22.

In the present case, the honeycombs of the honeycomb structure are arranged such that they extend with their longest extension, i.e. the connection of two mutually opposite corners, in the direction of the longitudinal axis X. Accordingly, two opposing sides of the honeycombs also lie in the direction of the longitudinal axis X.

As a result, two adjacent sides of the hexagon form ribs that converge at an angle in the direction of the container opening 30 and also in the direction of the container base 10.

Liquid in the container can easily run along and/or drain along this slope.

FIG. 2 shows an enlarged view of a portion of the container body 20 or of the repeating structure 21 located on the container body 20. FIG. 2 shows a single depression 22 and a rib 23 running around this depression 22. An outwardly directed bulge 24 is in the center in this depression.

In the present case, the depression 22 is designed as a hexagonal honeycomb. In its greatest length, it has a dimension A3 of 24 mm. The width A4 of the honeycomb between two parallel sides is 21.7 mm.

The depression 22 merges with a radius R1 (see FIG. 3) into a rib 23 adjacent to the depression 22. Between the radius R1 of a first transition and the radius R1 of a second transition, there is a region of the surface of the container body 20 on the rib 23, which region has a width A5 of 1.2 mm.

FIG. 3 shows a cross-section A-A from FIG. 2. The depression 22 is shown in cross-section. The cross-section shown here extends substantially rotationally symmetrically about the axis Z. The depression 22 has a depth A2 of 3.4 mm. In the region of the bulge 24, the depth A1 is about 2.6 mm.

FIG. 4 shows a sectional view through the reusable plastics container 100 of FIG. 1 during the rinsing process along the line B-B from FIG. 1.

The rays S1 to S4 convey the visibility of the depressions 22 starting from the container opening 30. By definition, the center of the container opening 30 is considered to be the starting point. It can be seen that the regions of the depressions 22 at the top in this illustration cannot be seen from the inlet opening 30. However, the remaining surfaces of the depressions 22 are visible from the container opening 30 and can be exposed to a corresponding water jet from the container opening 30.

In other words, only a small region above two sides of the hexagon is not accessible from the container opening 30. However, the remaining four sides and the entire surface of the hexagon can be directly sprayed with a water jet from the container opening 30.

The same also applies to the rib 23 running around the depression 22 (see also FIG. 2). The exposure of the ribs 23 is most apparent in FIG. 5 and in FIG. 4. These are described in the following with reference to this aspect.

FIG. 5 also shows a sectional view through the reusable plastics container of FIG. 1, but somewhat rotated relative to the cross-section from FIG. 4. The cross-section from FIG. 5 extends through the line C-C as drawn in FIG. 1. The section thus extends through the oblique sides of the depressions 22. The visibility of the ribs 23 and depressions 22 is indicated analogously to FIG. 4 by the rays S1 to S4.

As are visible from FIG. 4, a portion of the ribs 23 is oriented vertically, and hence extend in the direction of a water jet which is fed in the reusable plastics container from the container opening 30. These are correspondingly completely exposed to water during the rising process. The oblique sides of the depressions 22 are partially located in the shadow, viewed from the container opening 30, but only to a small extent. This part, which lies in the shadow, is thus not exposed directly to water during the rinsing process. However, this effect is reduced by the slope of these sides.

The direct impact of the water jet onto the surface to be cleaned results in turbulent currents arising here, and coatings on the surface are torn off downright.

FIG. 6 shows a sectional view analogous to the sectional view in FIG. 2 through an alternative reusable plastics container 100.

This reusable plastics container 100 has a plurality of horizontally surrounding ribs 40, in the present case two. The visibility from the container opening 30 is also illustrated by rays not described in detail here. The side of the ribs 40 facing the container opening 30 is completely visible from the container opening 30 and can accordingly be exposed to a water jet during the washing or rinsing process. Only portions of the surface lying in the shadow of the grooves 40 are not directly exposed to water. However, since these regions are very small, the flow remains turbulent even in these regions. Correspondingly, coatings which are arranged in these regions can also be effectively removed.

The grooves 40 according to FIG. 6 have a width of 4.2 mm and a depth of 1.2 mm. The grooves merge with a radius of 1.5 mm into the surface of the container body.

The reusable plastics containers 100, which are described in the present case, have a significantly lower weight compared to the prior art. Nevertheless, it can be cleaned at least just as well and at least as efficiently as the known reusable containers. Due to the arrangement of the structures as proposed, the rigidity of the bottles can be increased, wherein they can still be cleaned easily and efficiently due to their special shape.

Of course, the elements described with regard to individual embodiments can also be combined.

The invention claimed is:

1. A reusable plastics container (100) comprising a container body (20), a container base (10) and a container opening (30) located opposite the container base, wherein a repeating honeycomb structure (21) formed by depressions (22), which are deformations of the container body in the direction of the interior of the plastics container, and ribs (23) enclosing the depressions (22) is arranged on the container body (20), wherein at least 90% of the surfaces of the depressions (22) and the ribs (23) are visible from the container opening (30).

2. The reusable plastics container (100) according to claim 1, wherein at least 95% of the surfaces of the depressions (22) and the ribs (23) are visible from the container opening (30).

3. The reusable plastics container (100) according to claim 1, wherein at least 98% of the surfaces of the depressions (22) and the ribs (23) are visible from the container opening (30).

4. The reusable plastics container (100) according to claim 1, wherein the surfaces of the depressions (22) and the ribs (23) are completely visible from the container opening (30).

5. The reusable plastics container (100) according to claim 1, wherein the honeycomb structure (21) has a honeycomb size between 10 mm and 35 mm.

6. The reusable plastics container (100) according to claim 1, wherein the depressions (22) of the honeycomb structure (21) have a depth between 3 mm and 8 mm.

7. The reusable plastics container (100) according to claim 1, wherein transitions from the ribs (23) to the depressions (22) have radii that are greater than 1 mm.

8. The reusable plastics container (100) according to claim 1, wherein grooves (40) are formed on the container body (20) which are formed at an angle between 0° and 30° to the horizontal, wherein at least 90% of the surfaces of the grooves (40) are visible from the container opening (30).

9. The reusable plastics container (100) according to claim 8, wherein the grooves (40) have a width of 1 mm to 9 mm.

10. The reusable plastics container (100) according to claim 8, wherein the grooves (40) have a depth of 1 mm to 6 mm.

11. The reusable plastics container (100) according to claim 8, wherein transitions of the grooves (40) to the container body (20) have radii that are greater than 1 mm.

12. The reusable plastics container (100) according to claim 1, wherein the reusable plastics container (100) has an average wall thickness between 0.3 mm and 0.6 mm in a region of the container body.

13. The reusable plastics container (100) according to claim 1, wherein the reusable plastics container (100) is formed from materials from the list comprising PET, PEN, PLA, PEF, PE, PP, or mixtures thereof.

14. The reusable plastics container (100) according to claim 13, wherein the materials have a viscosity of 0.7 to 1.1 dl/g, preferably up to 0.9 dl/g, measured according to ASTM D4603 on the input pellets.

15. The reusable plastics container (100) according to claim 13, wherein copolymers from the list of copolymers having 0.5% to 3% IPA, CHDM, FDCA or DEG are selected as the materials.

16. The reusable plastics container (100) according to claim 1, wherein the reusable plastics container (100) is stiffened by the grooves (40) or by the repeating structure (21) in such a way that a punctual force of 30N per $cm^2$ does not cause plastic deformation.

17. The reusable plastics container (100) according to claim 1, wherein the number of colony-forming units (CFU) after the washing process is less than 30.

18. The reusable plastics container (100) according to claim 1, wherein the honeycomb structure and grooves (40) extend from an exterior surface of the container body inwardly and are formed in portions on the container body (20).

19. The reusable plastics container (100) according to claim 1, wherein the reusable plastics container has a volume of 200 ml to 3000 ml.

20. The reusable plastics container (100) according to claim 1, wherein the reusable plastics container is produced from a preform by a plug-in blow molding method.

* * * * *